US008794794B2

(12) United States Patent
Kato et al.

(10) Patent No.: US 8,794,794 B2
(45) Date of Patent: Aug. 5, 2014

(54) LAMP UNIT AND LUMINAIRE

(75) Inventors: Go Kato, Kanagawa-ken (JP); Tomokazu Usami, Kanagawa-ken (JP); Kenji Nezu, Kangawa-ken (JP); Junichi Kimiya, Saitama-ken (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 13/615,766

(22) Filed: Sep. 14, 2012

(65) Prior Publication Data

US 2013/0201699 A1 Aug. 8, 2013

(30) Foreign Application Priority Data

Feb. 3, 2012 (JP) ..... 2012-021614

(51) Int. Cl.
*F21V 23/00* (2006.01)

(52) U.S. Cl.
USPC ..... 362/249.02; 362/311.02

(58) Field of Classification Search
USPC ..... 362/249.02, 294, 373, 311.02
See application file for complete search history.

(56) References Cited

U.S. PATENT DOCUMENTS 6,111,359 A * 8/2000 Work et al. ..... 315/56
7,758,223 B2 * 7/2010 Osawa et al. ..... 362/547
8,282,243 B2 * 10/2012 Uemoto et al. ..... 362/249.02
2009/0268470 A1 * 10/2009 Okimura et al. ..... 362/311.02
2011/0176311 A1 * 7/2011 Lin et al. ..... 362/249.02
2012/0049736 A1 * 3/2012 Shimizu et al. ..... 315/53
2013/0044500 A1 2/2013 Reingruber
2013/0135858 A1 * 5/2013 Wu et al. ..... 362/235

FOREIGN PATENT DOCUMENTS

DE 102010028481 A1 11/2011
EP 2 149 742 A2 2/2010
EP 2 469 161 A1 6/2012
JP 2011-171160 9/2011
WO WO2011145252 * 11/2011 ..... 362/249.02
WO 2012/005239 A1 1/2012

OTHER PUBLICATIONS

Extended EP SR mailed Feb. 5, 2013, EP App 12184975.6.

* cited by examiner

*Primary Examiner* — Peggy Neils
(74) *Attorney, Agent, or Firm* — Banner & Witcoff, Ltd.

(57) ABSTRACT

A lighting circuit substrate is arranged in a cap so that one surface of a lighting circuit substrate and a flat portion of a cap projection are arranged so as to face each other. Also, lighting circuit components are mounted on the one surface of the lighting circuit substrate, and the lighting circuit components are arranged within the cap projection. Arrangement is such that a clearance between the lighting circuit substrate and the flat portion of the cap projection becomes larger than the height of a component whose projecting dimension from the lighting circuit substrate is the largest from among the lighting circuit components.

7 Claims, 3 Drawing Sheets

LAMP UNIT AND LUMINAIRE

CROSS-REFERENCE TO RELATED APPLICATION

The application is based upon and claims the benefit of priority from Japanese Patent Application No. P2012-021614, filed on Feb. 3, 2012; the entire contents of which are incorporated herein by references.

FIELD

Embodiments described herein relate generally to a lamp unit and a luminaire.

BACKGROUND

In the related art, there is a lamp unit using a cap of GX53 type. The lamp unit of this type includes a disk-shaped base member. A light source is arranged on one surface side of the base member, the cap is arranged on the other surface side, and a lighting circuit is arranged between the base member and the cap.

The cap is formed with a cap surface portion in a peripheral portion of the other surface and is formed with a cap projection at a center portion of the other surface so as to project from the other surface side of the cap surface portion and having an interior opening toward the one surface side, and is provided with a pair of lamp pins projecting from the other surface side of the cap surface portion.

The lighting circuit includes a lighting circuit substrate and a plurality of lighting circuit components mounted on the lighting circuit substrate, and both of the lighting circuit substrate and the lighting circuit components are arranged within the cap projection.

The above mentioned technology is disclosed in Japanese Patent Application Laid-Open No. 2011-171160, and contents of which are hereby incorporated by reference.

DETAILED DESCRIPTION

Reduction in thickness of a lamp unit is achieved by arranging an entire lighting circuit including a lighting circuit substrate and lighting circuit components in a cap projection of a cap.

However, when arranging the lighting circuit in the cap projection, an earth on the side of a luminaire and the lighting circuit are liable to be arranged in proximity to each other, and hence a noise caused by an operation of the lighting circuit may be coupled with the earth and deteriorate a noise level.

In view of such circumference, a lamp unit according to an exemplary embodiment includes abase member, a light source mounted on one surface side of the base member, and a cap mounted on the other surface side. The cap is formed with a cap projection having a flat portion at a center portion thereof. A lighting circuit substrate is arranged in the cap so that one surface of the lighting circuit substrate and the flat portion of the cap projection are arranged so as to face each other.

Also, the lighting circuit components are mounted on the one surface of the lighting circuit substrate, and the lighting circuit components are arranged within the cap projection. The lighting circuit components are arranged so that a clearance between the lighting circuit substrate and the flat portion of the cap projection becomes larger than the height of a component projecting most from the lighting circuit substrate from among the lighting circuit components.

According to the exemplary embodiment, inhibition of deterioration of a noise level of the lamp unit is expected.

Figure 1:
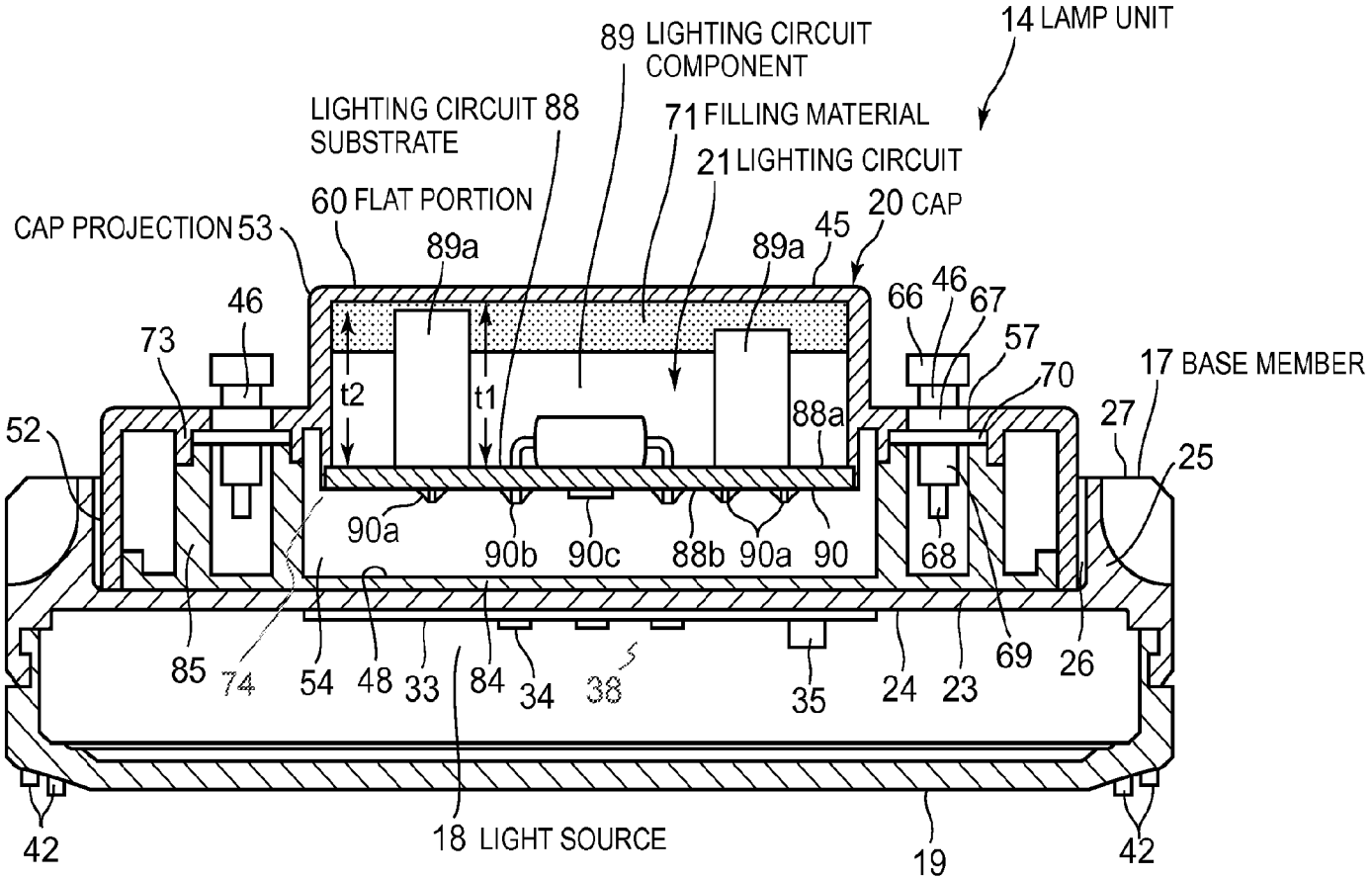
FIG. 1 is a cross-sectional view of a lamp unit according to an exemplary embodiment.
Figure 2:
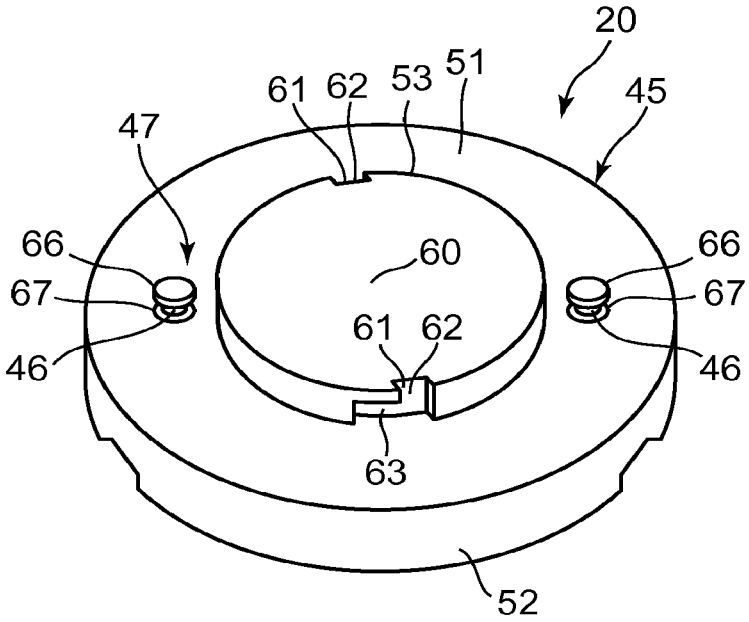
FIG. 2 is a perspective view of a cap of the lamp unit.
Figure 3:
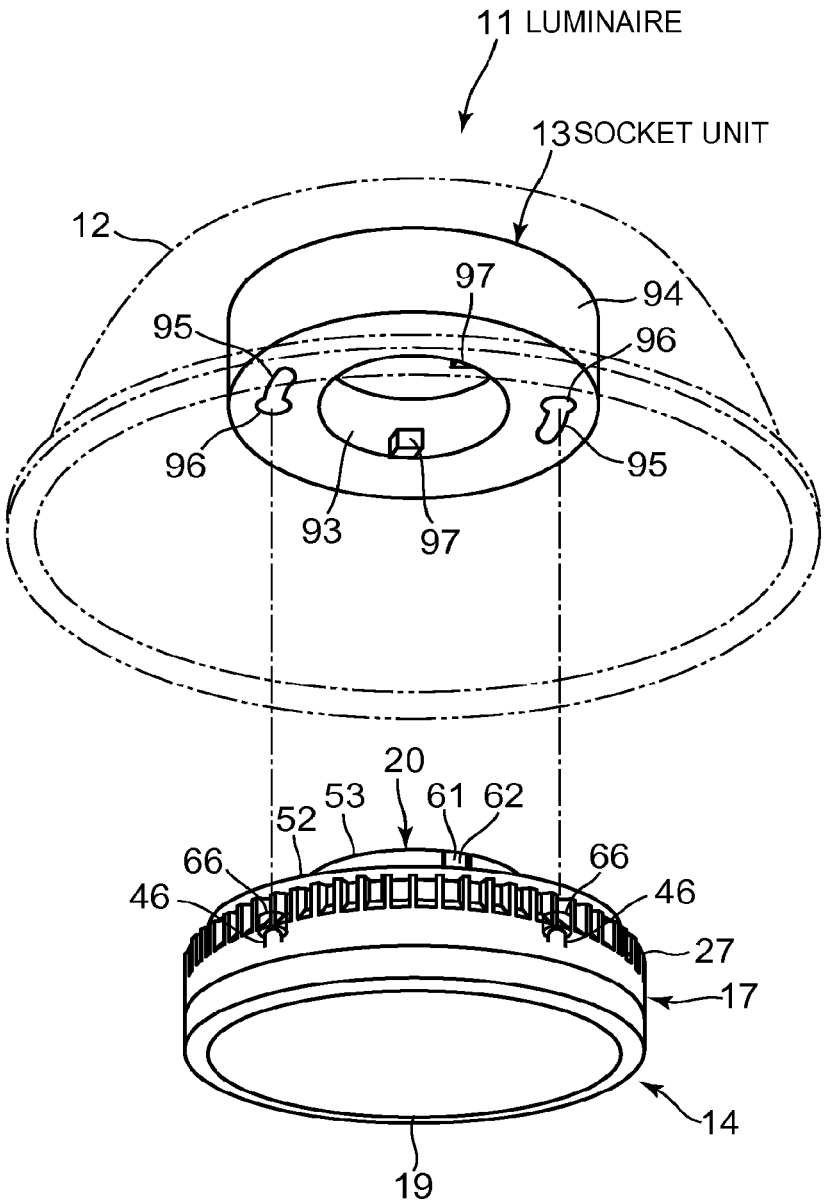
FIG. 3 is a perspective view of a luminaire having the lamp unit.

Referring now to FIG. 1 to FIG. 3, an embodiment will be described.

As illustrated in FIG. 3, a luminaire 11 is, for example, a downlight, and includes an apparatus body 12, a socket unit 13 assembled to the apparatus body 12, and a flat-type lamp unit 14 to be demountably mounted on the socket unit 13. As regards the directional relationship such as upward and downward directions thereof is given assuming that the light-source side as the one surface side or the end side of the lamp unit 14 is the lower side and a cap side as the other surface side or the other end side is the upper side with reference to a state in which the flat lamp unit 14 is mounted horizontally.

The apparatus body 12 is, for example, formed of a metal or a synthetic resin, and is configured to integrally have a reflector function opening on a lower surface thereof.

Subsequently, as illustrated in FIG. 1 to FIG. 3, the lamp unit 14 includes a disk-shaped base member 17, a light-emitting module 18 mounted on a lower surface of the base member 17 as a light source, a globe 19 mounted on the lower surface of the base member 17 so as to cover the light-emitting module 18, a cap 20 mounted on an upper surface of the base member 17, and a lightening circuit 21 accommodated in the cap 20.

The base member 17, for example, is integrally formed of a metal or ceramics such as aluminum die-casting superior in heat conductivity and thermal radiation properties. The base member 17 includes a substrate mounting portion 23 formed into a flat disk shape, a substrate mounting surface 24 on which the light-emitting module 18 is mounted in tight contact thereto so as to allow thermal conduction is formed on a lower surface of the substrate mounting portion 23, a cylindrical peripheral edge portion 25 is formed on a peripheral portion of an upper surface of the substrate mounting portion 23, a circular and depressed cap enclosure 26 which allows fitting of the cap 20 on the inner side of the peripheral edge portion 25 is formed, and a plurality of thermal radiating fins 27 are formed on the outside of the peripheral edge portion 25.

The light-emitting module 18 includes a substrate 33, a light-emitting portion 34 formed at a center portion of a lower surface of the substrate 33, and a connector 35 attached to an outer peripheral side of the substrate 33 with respect to the light-emitting portion 34. The substrate 33 is fixed directly to the substrate mounting surface 24 by a plurality of screws screwed into the substrate mounting portion 23 of the base member 17, so that desirable thermal conductivity from the light-emitting module 18 to the base member 17 is secured. The substrate mounting surface 24 of the base member 17 is painted white except for a portion where the substrate 33 is assembled.

The substrate 33 is formed into a substantially square shape, for example, of a metal or ceramics such as aluminum die-casting superior in heat conductivity and thermal radiation properties.

The light-emitting portion 34 employs semiconductor light-emitting elements such as LED elements or EL elements. In the exemplary embodiment, the LED elements are employed as the semiconductor light-emitting elements and a system of mounting a plurality of SMD (Surface Mount Device) packages having connecting terminals and the LED elements mounted thereon on the substrate 33 is employed. As the LED elements, for example, LED elements emitting blue light are employed, and a white LED package mixed with phosphor excited by part of the blue light from the LED elements and radiating yellow light is used. The light-emitting portion 34 may employ a COB (Chip On Board) system in which a plurality of the LED elements are mounted on the substrate 33. In other words, a configuration in which the plurality of LED elements are mounted on the substrate 33, the plurality of LED elements are electrically connected to the plurality of LED element in series by wire bonding, and the plurality of LED elements are integrally covered with a phosphor layer, which is a transparent resin such as a silicone resin mixed with phosphor and sealed is also applicable.

The globe 19 is formed of a synthetic resin or glass, for example, has translucency and diffusing properties, is fitted to a peripheral edge portion of the base member 17 so as to cover the light-emitting module 18 mounted on the substrate mounting surface 24 of the base member 17, and is locked by a claw structure. Provided in a peripheral portion of a surface of the globe 19 is a pair of display projections 42 for displaying the positions of lamp pins.

The cap 20 is of GX53 type, has a cap body 45, and the cap body 45 includes a pair of lamp pins 46 and a cap cover 48 assembled thereto.

The cap body 45 is, for example, superior in thermal radiating properties, is formed integrally of a resin having electrical insulation properties, and includes an annular cap surface portion (mounting surface portion) 51 formed on a peripheral portion of an upper surface, a cylindrical peripheral surface portion 52 projecting from a peripheral edge portion of the cap surface portion 51 on the side of a lower surface, and a cylindrical cap projection 53 projecting from a center area of the cap surface portion 51 on the side of an upper surface. Accordingly, the cap body 45 is oriented so that the interiors of the cap surface portion 51 and the cap projection 53 opened downward, and a lighting circuit enclosure 54 configured to accommodate the lighting circuit 21 is formed in the opening.

A plurality of bosses, not illustrated, are formed on an inner surface of the peripheral surface portion 52, and a plurality of screws, not illustrated, are respectively screwed into the bosses through the base member 17, so that the base member 17 and the cap 20 are fixed. The cap surface portion 51 is formed with a pair of openings 57 at positions symmetry with respect to a center of the cap 20 and corresponding to positions where the pair of lamp pins 46 are arranged. An upper surface of the cap projection 53 is formed with a flat portion 60 which has a circular shape in front view, and is closed.

The cap projection 53 is formed on an outer peripheral surface thereof with a pair of key groove portions 61 at positions symmetry with respect to the center of the cap 20 and deviated from the positions where the pair of lamp pins 46 are arranged. The key groove portions 61 each formed into a substantially L-shape including a vertical groove 62 formed so as to communicate with the upper surface of the cap projection 53 along the vertical direction, and a lateral groove 63 formed on a lower portion of the cap projection 53 along the circumferential direction of the cap projection 53.

The lamp pins 46 are formed of a metal having electrical conductivity, and each include a large-diameter portion 66 on an upper end thereof, a mounting portion 67 to be assembled to the opening 57 of the cap surface portion 51 at a center portion thereof, a pin-shaped connecting portion 68 to be electrically connected to the lighting circuit 21 with lead wires, not illustrated, at a lower end thereof, a large diameter portion 69 larger in diameter than the connecting portion 68 between the mounting portion 67 and the connecting portion 68, and a substantially disk-shaped abutting portion 70 larger in diameter than the large diameter portion 69 between the large diameter portion 69 and the mounting portion 67.

Each of lamp pin mounting portions 73 projecting into a cylindrical shape from a periphery of each opening 57 toward a lower end thereof is formed inside the cap surface portion 51. The lamp pin mounting portion 73 is formed with a notch at apart of the cylinder for allowing the lead wire configured to electrically connect the lighting circuit 21 and the lamp pins 46 to pass through. The abutting portions 70 of the lamp pins 46 are fitted into the inside of the lamp pin mounting portions 73.

A pair of lighting circuit substrate holding portions 74 are formed from a peripheral edge of the cap projection 53 toward a lower end thereof, and are configured to come into abutment with one of surfaces of a lighting circuit substrate 88 of the lighting circuit 21 to achieve positioning restriction. Claws may be formed so as to project from the lighting circuit substrate holding portions 74 to hold the lighting circuit substrate of the lighting circuit 21 therewith.

The cap cover 48 is formed of a synthetic resin having insulating properties and heat insulating properties, and includes a closing portion 84 configured to close the lower opening of the cap body 45, and holding portions 85 coming into abutment with lower surfaces of the abutting portions 70 of the lamp pins 46 are formed so as to project from the closing portion 84. The cap cover 48, when fixing the base member 17 and the cap 20 fixes the lamp pins 46 to the cap 20 by the respective holding portions 85 coming into abutment with the lower surfaces of the abutting portions 70 of the lamp pins 46 and the abutting portions 70 held tightly between the holding portions 85 and the cap surface portion 51.

The lighting circuit 21 constitutes a power supply circuit configured to output DC power at a constant current and, in the exemplary embodiment, is composed of a switching power supply, and includes the disk-shaped lighting circuit substrate 88 and lighting circuit components 89 which are a plurality of electronic components mounted on the lighting circuit substrate 88.

The lighting circuit substrate 88 is formed into a disk shape having a diameter slightly smaller than the inner diameter of the cap projection 53 of the cap 20. An upper surface of the lighting circuit substrate 88, which is one surface, corresponds to a mounting surface 88*a* on which the lighting circuit components 89 are mounted, and a lower surface, which is the other surface, is a wiring pattern surface 88*b* formed with a wiring pattern 90. The exemplary embodiment is described by exemplifying a one-side mounting substrate, and the mounting surface 88*a* corresponds to a component mounting surface, the wiring pattern surface 88*b* corresponds to a soldering surface. Here, electric currents and voltages flowing through the wiring pattern 90 vary depending on the type of the lighting circuit component to be connected. For example, the switching power supply circuit generally generates a high-voltage and a high current, and the wiring pattern 90 to which a switching power supply circuit component is connected corresponds to a high-frequency power supply pattern 90*a*. The wiring pattern 90 which is a ground potential corresponds to a ground potential pattern 90*b*, and the wiring pattern 90 in which a high-frequency voltage is not generated corresponds to a stable potential pattern 90*c*. In the exemplary embodiment, since the one-side mounting substrate is employed, the high-frequency power supply pattern 90*a*, the ground potential pattern 90*b* and the stable potential pattern 90*c* are disposed on the wiring pattern surface 88*b*.

Then, the lighting circuit substrate 88 faces a lower surface of the cap projection 53 at a predetermined distance, is supported by the lighting circuit substrate holding portions 74, and is arranged within the cap 20.

The lighting circuit components 89 to be mounted on the mounting surface 88*a* of the lighting circuit substrate 88 are discrete components having a lead wire, and the lead wire penetrates through the lighting circuit substrate 88 and is connected by soldering to the wiring pattern 90 of the wiring pattern surface 88*b*. Examples of tall and large components include an electrolytic capacitor of a rectification and smoothing circuit configured to rectify and smooth an AC voltage, an inductor of a chopper circuit configured to covert the rectified and smoothed voltage to a predetermined voltage, and resistors used in other circuits. Lighting circuit components 89*a* projecting significantly from the lighting circuit substrate 88 are accommodated at least partly within the cap projection 53. A filling material 71 such as a silicone resin having thermal conductivity is filled between the cap projection 53 and the lighting circuit substrate 88, and the lighting circuit components 89*a* are fixed to the cap projection 53 of the cap 20, so that heat generated by the lighting circuit components 89 is efficiently conducted to the cap 20. Here, a clearance t1 between the lighting circuit substrate 88 and the flat portion 60 is larger than a height t2 of the lighting circuit components 89 which project most from the substrate. In this manner, the lighting circuit components 89 are fixed to the flat portion 60 of the cap projection 53 with the filling material 71, and the lighting circuit substrate 88 is arranged away from the flat portion 60 of the cap projection 53.

Examples of low and small components include a switching element of the chopper circuit, capacitors and diodes.

Surface mounted components from among the lighting circuit components 89 are surface-mounted on the wiring pattern surface 88*b* of the lighting circuit substrate 88. Examples of the surface-mounted components include chip resistors and chip capacitors.

The respective lamp pins 46 are connected to input terminals of an AC power supply of the lighting circuit 21, and an electric wire, not illustrated, connected to an output terminal of a DC power source of the lighting circuit 21 is electrically connected to the light-emitting module 18 through wiring holes formed respectively through the cap cover 48 and the base member 17.

Subsequently, the effect of the lamp unit of the exemplary embodiment will be described.

The cap surface portion 51 of the lamp unit 14 is assembled to the socket unit, and the flat portion 60 of the cap projection 53 is arranged in proximity to the luminaire. Here, if the lighting circuit components 89 are arranged in the cap projection 53 in order to arrange the lighting circuit 21 efficiently, the lighting circuit 21 and the luminaire are arranged in proximity to each other. Here, when the lighting circuit 21 includes a switching power supply, the high-frequency power supply pattern 90*a* is formed on the lighting circuit substrate 88. In other words, the high-frequency power supply pattern 90*a* is arranged in proximity to the luminaire side, and hence the noise generated by the operation of the switching power supply is coupled to the earth on the luminaire side and deteriorates a noise level. In order to radiate heat generated by the lighting circuit 21, it is preferable that the cap 20 and the lighting circuit 21 are thermally connected by a filling material such as a heat radiating resin having thermal conductivity. However, since the heat radiating resin generally contains a conductive component, a state of low impedance is resulted for the high frequencies.

Accordingly, in the lamp unit 14 in the exemplary embodiment, deterioration of the noise level is inhibited by arranging the mounting surface 88*a* of the lighting circuit substrate 88 so as to face the flat portion 60 and arranging the wiring pattern surface 88*b* so as to face the side opposite the flat portion 60 so that the lighting circuit substrate 88 is arranged apart from the flat portion 60 to prevent easy coupling of the noise generated by the operation of the switching power supply to the earth. Since the lighting circuit component 89*a* projecting significantly from the lighting circuit substrate 88 arranged so as to face the flat portion 60 is thermally connected to the cap projection 53 with the filling material 71, heat generated by the lighting circuit 21 may be radiated efficiently. Furthermore, since the high-frequency power supply pattern 90*a* is formed on the wiring pattern surface 88*b*, the high-frequency power supply pattern 90*a* may be positioned away from the flat portion 60 and hence heat of the lighting circuit components 89 may be radiated while inhibiting lowering of a high-frequency impedance by placing the filling material 71 away from the high-frequency power supply pattern 90*a*.

When a multilayer substrate or a both-side mounted substrate on which the ground potential pattern, the stable potential pattern, and the high-frequency power supply pattern are formed is used, the noise level may be reduced as in the exemplary embodiment by a configuration in which a clearance of the high-frequency power supply pattern from the flat portion of the cap projection is formed to be larger than that of the ground potential pattern or the stable potential pattern.

Subsequently, as illustrated in FIG. 3, the socket unit 13 includes an annular socket body 94 having an opening 93 at a center thereof. Formed on a lower surface of the socket body 94 are a pair of connecting holes 95 which allow insertion and rotation of the respective lamp pins 46 of the lamp unit 14 at positions symmetry with respect to a center of the socket unit 13. The connecting holes 95 are elongated holes extending along the circumferential direction of the socket body 94, and each include at one end thereof an enlarged diameter portion 96 which allows insertion of the large-diameter portion 66 of the lamp pin 46. Accommodated inside the respective connecting holes 95 are terminals, not illustrated, to which the lamp pins 46 inserted into the connecting holes 95 are electrically connected.

Formed on an inner peripheral surface of the socket body 94 so as to project therefrom are key portions 97 configured to fit into the substantially L-shaped key groove portions 61 formed on the outer peripheral surface of the cap projection 53 of the cap 20 in association with the insertion and rotation of the lamp pins 46 of the cap 20 into the connecting holes 95, and support the cap 20 on the socket body 94.

Subsequently, operation of the luminaire 11 will be described.

In order to mount the lamp unit 14 on the socket unit 13, the projecting portion 53 of the cap 20 of the lamp unit 14 is inserted into the opening 93 of the socket unit 13, the position of the lamp unit 14 in the circumferential direction is adjusted, and the large-diameter portions 66 of the lamp pins 46 are inserted into the enlarged-diameter portions 96 of the connecting holes 95 of the socket unit 13. Accordingly, the vertical groove portions 62 of the respective key groove portions 61 of the cap 20 are fitted into the respective key portions 97 of the socket unit 13.

By rotating the lamp unit 14 in the mounting direction in a state in which the lamp unit 14 is pressed against the socket unit 13, the respective lamp pins 46 of the lamp unit 14 move within the connecting holes 95 of the socket unit 13 and hence are electrically connected to the respective terminals arranged inside the connecting holes 95 and the lateral groove portions 63 of the key groove portions 61 of the cap 20 are fitted into the key portions 97 of the socket unit 13, whereby the lamp unit 14 is mounted on the socket unit 13.

Power is fed from a power source line to the lightening circuit 21 through the terminal of the socket unit 13 and the lamp pins 46 of the lamp unit 14, so that the lighting power is supplied from the lightening circuit 21 to a plurality of semiconductor light-emitting elements 38 of the light-emitting module 18, the plurality of semiconductor light-emitting elements 38 are turned ON, and the light is emitted from the light-emitting portion 34.

Heat generated by the semiconductor light-emitting elements 38 of the light-emitting module 18 in the ON state is mainly conducted to the substrate 33, is conducted from the substrate 33 to the base member 17, and is radiated into the air from an outer surface having the thermal radiating fins 27 of the base member 17.

Heat generated by the lighting circuit components 89 of the lightening circuit 21 is efficiently conducted to the cap 20 via the filling member 71 with which mainly the lighting circuit components 89 come into contact, and is conducted from the cap 20 into the air or to the socket unit 13 and is radiated therefrom.

The lamp unit 14 is arranged in the cap 20 with the lighting circuit substrate 88 facing the flat portion 60 of the cap projection 53 and the lighting circuit components 89 projecting significantly from the lighting circuit substrate 88 are disposed within the cap projection 53. Therefore, the lighting circuit components 89 may be arranged efficiently in the cap 20 and the lighting circuit substrate 88 is arranged away from the flat portion 60, so that the deterioration of the noise level may be inhibited.

In addition, since the components projecting significantly from the lighting circuit substrate 88 from among the lighting circuit components 89 are connected to the flat portion 60 of the cap projection 53 with the filling material 71 having thermal conductivity, heat generated by the lighting circuit components 89 may be efficiently radiated from the cap 20. Since only the lighting circuit components 89 are connected with the filling material 71 and the lighting circuit substrate 88 is not filled with the filling material 71, occurrence of lowering of the high-frequency impedance between the high-frequency power supply pattern 90*a* and the flat portion 60 is inhibited.

Since the mounting surface 88*a* of the lighting circuit substrate 88 faces toward the flat portion 60 of the cap projection 53 and the wiring pattern surface 88*b* is arranged so as to face the side opposite from the cap 20, the high-frequency power supply pattern 90*a* may be arranged away from the flat portion 60.

Accordingly, for example, formation of an electrostatic capacitance component between the earth portion and the high-frequency power supply pattern 90*a* of the luminaire or the like is inhibited, so that the noise level may be reduced.

A configuration in which a both-side substrate having the wiring pattern formed on the both sides of the lighting circuit substrate 88 is employed as the lighting circuit substrate 88 and the high-frequency power supply pattern 90*a* is disposed on the side opposite the surface arranged so as to face the cap projection 53.

The light source is not limited to the semiconductor light-emitting elements 38, and may be a fluorescent lamp arranged flatly along the lower surface of the base member 17.

In the exemplary embodiments described above, the lamp pins 46 of the lamp unit 14 may be used for an electrical connection and support of the lamp unit 14 on the socket unit 13, and the key groove portions 61 of the lamp unit 14 and the key portions 97 of the socket unit 13 may not be provided. Alternatively, it is also possible to use the lamp pins 46 of the lamp unit 14 only for the electric connection, and support the lamp unit 14 on the socket unit 13 only by the key groove portions 61 of the cap 20. In this case, the lamp pins 46 may not be provided with the large-diameter portions 66.

Although several exemplary embodiments have been described, these embodiments are illustrated as examples and are not intended to limit the scope of the invention. The novel exemplary embodiments may be implemented in other various modes, and various omissions, replacements, and modifications may be made without departing the scope of the invention. The exemplary embodiments and the modifications thereof are included in the scope and gist of the invention, and are included in claims and the equivalent scope thereto.

What is claimed is:

1. A lamp unit comprising:

a base member;

a light source mounted on one surface side of the base member;

a cap mounted on the other surface side of the base member and formed with a cap projection having a flat portion at a center portion thereof; and a lighting circuit having a lighting circuit substrate arranged in the cap with one surface facing the flat portion of the cap projection and lighting circuit components mounted on the one surface of the lighting circuit substrate and arranged within the cap projection, in which a clearance between the lighting circuit substrate and the flat portion of the cap projection is larger than the height of a component projecting most from the lighting circuit substrate from among the lighting circuit components, wherein the lighting circuit substrate includes a ground potential pattern, a stable potential pattern, and a high-frequency power supply pattern, and the high-frequency power supply pattern has a clearance from the flat portion of the cap projection larger than the ground potential pattern or the stable potential pattern.

2. The unit according to claim 1, wherein components projecting significantly from the lighting circuit substrate from among the lighting circuit components of the lighting circuit are connected to the flat portion of the cap projection with a resin having thermal conductivity.

3. The unit according to claim 1, wherein a high-frequency power supply pattern is formed on the other surface of the lighting circuit substrate.

4. The unit according to claim 1, wherein the lighting circuit substrate is a one-side mounted substrate, and includes a component mounted surface on one side and a wiring pattern surface on the other side.

5. A luminaire comprising:

an apparatus body;

a socket unit to be mounted on the apparatus body; and a lamp unit including a base member, a light source mounted on one surface side of the base member, a cap mounted on the other surface side of the base member and formed with a cap projection having a flat portion at a center portion thereof, and a lighting circuit having a lighting circuit substrate arranged in the cap with one surface facing the flat portion of the cap projection and lighting circuit components mounted on the one surface of the lighting circuit substrate and arranged within the cap projection, in which a clearance between the lighting circuit substrate and the flat portion of the cap projection is larger than the height of a component projecting most from the lighting circuit substrate from among the lighting circuit components, and is configured to mount in the socket unit, wherein a high-frequency power supply pattern is formed on the other surface of the lighting circuit substrate, and wherein the lighting circuit substrate includes a ground potential pattern a stable potential pattern, and the high-frequency power supply pattern, and the high-frequency power supply pattern has a clearance from the flat portion of the cap projection larger than the ground potential pattern or the stable potential pattern.

6. The luminaire according to claim 5, wherein components projecting significantly from the lighting circuit substrate from among the lighting circuit components of the lighting circuit are connected to the flat portion of the cap projection with a resin having thermal conductivity.

7. The luminaire according to claim 5, wherein the lighting circuit substrate is a one-side mounted substrate, and includes a component mounted surface on one side and a wiring pattern surface on the other side.

* * * * *